United States Patent [19]

Böder

[11] 4,291,649

[45] Sep. 29, 1981

[54] PROCESS AND APPARATUS FOR DUCTING FLUE GAS WITHIN A BOILER

[75] Inventor: Wilfried Böder, Barsinghausen, Fed. Rep. of Germany

[73] Assignee: PPT Pyrolyse-und Prozessanlagentechnik GmbH & Co., Hanover, Fed. Rep. of Germany

[21] Appl. No.: 47,629

[22] Filed: Jun. 11, 1979

[30] Foreign Application Priority Data

Jun. 14, 1978 [DE] Fed. Rep. of Germany ..... 2826048
Aug. 18, 1978 [DE] Fed. Rep. of Germany ..... 2836251

[51] Int. Cl.[3] ..... F22B 7/00

[52] U.S. Cl. ..... 122/136 R; 122/20 B; 122/182 R; 122/421

[58] Field of Search ..... 122/136 R, 138, 149, 122/182 R, 20 B, 421, 406 S, 451 S

[56] References Cited

U.S. PATENT DOCUMENTS

| | | | |
|---|---|---|---|
| 794,821 | 7/1905 | Suzuki | 122/182 R |
| 1,402,045 | 1/1922 | Brunett | 122/20 B |
| 1,711,365 | 4/1929 | Summers | 122/182 R |
| 1,734,490 | 11/1929 | Jones | 122/182 R |
| 2,020,686 | 11/1935 | Kaiser | 122/20 B |
| 3,035,408 | 5/1962 | Silver | 60/602 |
| 3,908,604 | 9/1975 | Vocklinghaus | 122/421 |
| 4,005,578 | 2/1977 | McInerney | 60/602 |

*Primary Examiner*—Henry C. Yuen
*Attorney, Agent, or Firm*—Darby & Darby

[57] ABSTRACT

In the boiler plant the flue gases coming from the firing space undergo division into at least two part-currents which are cooled to different degrees by giving up heat to a heat exchange medium and are then mixed together partly for producing a gas current with a desired temperature dependent on the rates of mixing of the two part-currents. The mixed current is then taken up by a heat user. Parts of the flue gases not going to the heat user are run through all heat absorbers of the system as far as the off-gas stack. The amounts of the part-currents of flue gases, used for forming the gas current with the desired temperature of mixing, are controlled dependent on the mixing temperature.

29 Claims, 4 Drawing Figures

PROCESS AND APPARATUS FOR DUCTING FLUE GAS WITHIN A BOILER

BACKGROUND OF THE INVENTION (i) Field of the Invention

The invention relates to a process for ducting or routing flue gases produced in the firing space of a boiler, in the case of which the flue gases within the boiler and giving up heat are run through heat absorbers themselves cooled by heat transport material and run to an off-gas stack; the invention is furthermore with respect to apparatus for undertaking this process for ducting or flowing flue gas.

(ii) The prior art

In the case of old heat producers (steam producers on the one hand and hot or warm water producers on the other) there has been a suggestion to make use of multi-pass heat producers, and more specially three-pass producers (see for example the German Industrial Standards (DIN) 4751, 4752 and the like). In the case of such old heat producers the multi-pass design made possible a generally high level of use of the heat development in the firing space.

In the case of a great number of process as used in industry, as for example thermo-chemical processes, heating systems for dryers in the wood and surface coating industries, for stretching or tenter frames in the textile industries, and dryers in the petroleum industry, it has, however, turned out to be necessary to make use of flue gases for direct or indirect heating in a temperature range between about 500° C. and 900° C. For such purposes the flue gases coming from normal heat producing plant, may not be used, because their temperature level (up to about 300° C.) is far under the desired figure. So it has so far been necessary to make use of direct burner systems for such processes, in the case of which the flue gases produced in the firing space and having a high temperature, are lowered to the desired temperature by mixing in fresh air or by using only a part of the flue gases produced. In the two cases a markedly great amount of the radiation heat, produced in the firing space, and, in part, furthermore of the convection heat produced in the plant, was wasted so that the efficiency of such a plant under the desired level.

OVERVIEW OF THE INVENTION

Taking such systems of the prior art as a starting point, one purpose of the present invention is that of making such a better design of a process for ducting flue gas of the sort noted at the start that it makes possible the operation of the boiler as a heat producer with a normal range of use, while at the same time making it simply possible for flue gases at any desired temperature in a range between about 500° C. and about 900° C. to be taken off, the system being specially economic. Furthermore, a purpose of the invention is that of designing an apparatus for undertaking such a process.

In a process of the sort noted in the first place, the purpose of the invention is effected in that the flue gases coming from the firing space undergo division-up into at least two part-currents, the separate part-currents are cooled to different degrees by giving up heat to the transport material or medium, and then at least partly mixed together again forming a gas current whose mixing temperature may undergo selection as desired, and then, at least in part, are run to an output flue gas user, in the case of which the parts of the flue gases not going to the user are run as far as through the last heat-absorber to the off-gas stack and the parts of the part-currents used for forming the gas current, whose mixing temperature may undergo selection, are controlled dependent on the desired mixing temperature. Because of the process of the present invention it is possible, in respect of the normal heat production boiler, for all the heat of radiation produced and the necessary convection heat to be taken from the system and at the same time for flue gases at the desired or needed temperature to be taken off within the given temperature range without stopping any use for an output user. In comparison with normal ways of working, in which it was only for producing the flue gases with the necessary temperatures that a separate burner was used for the user at the output, there is the useful effect, for which the process of the invention is responsible, that by combination of a normal heat producer and a flue gas producer at one unit the overall level of emission is strongly decreased by there being one less firing system; at the same time a specially low price from each unit of output is made possible, because the full heat of radiation coming from the flame produced may be used for normal heat production and the convection heat necessary may be used as well. Even the rest of the flue gas, not needed for the output flue gas user or consumer, is used for the heat producing side of the boiler till it is run into the flue gas stack.

One further development of the process of the invention of good effect is that the separate part-currents, after running through the heat absorbers, are joined together again completely for forming the current of gas whose mixing temperature undergoes selection as desired, and the flue gas flow of the part-currents is, more specially automatically controlled along the heat absorbers for producing the mixing temperature whose selection is made.

This may be done specially simply if the control of the flue gas flow along the heat absorbers is undertaken by opening or shutting, completely or in part, the cross-sections of the heat absorbers which are in the form of pipes. In this respect the use of simple troublefree mechanical parts is possible; for certain uses coming into question it may, however, be of good effect if another control system of the necessary sort is used for the flow of flue gas in the heat absorbers, using, for example, valves or the like with controllers.

To make possible simple automatic pressure control at the flue gas side, it is of good effect for the flue gas output flow to the user to be able to undergo adjustment after mixing and for the flue gas flow through at least the last heat absorber to be able to be choked back for producing a different resistance for the flue gas. In this way it is possible to make certain that on taking gas off through the output flue gas user the flue gases going into the flue gas stack do not have any undesired effect on the flue gas side pressure of the overall system, with the outcome that pressure regulation on the flue gas side as necessary for orderly operation of such a plant is made simple and may be readily undertaken.

A markedly high-level of efficiency may be produced if the flue gas is ducted or flowed along the heat absorbers, joined with the output of the firing space, in the opposite direction of the flue gas in the firing space itself and along the last heat absorber.

The process of the invention may be best used with a good effect for ducting flue gas in the case of forced circulation or once-through boilers if the flue gases undergo division into two part-currents, of which one is run by way of the heat absorbers present (cooling loops) to the flue gas stack and from this position is mixed, at least in part, with the other part-current again (which till this point in time has been kept generally uncooled) for producing the gas current whose mixing temperature undergoes selection as desired.

In the process of the invention the flue gas temperature and the flue gas pressure, are automatically controlled where the mixing together of the gases takes place, in such a way that the temperature is put at the value dependent on the needs of the output flue gas user and the flue gas pressure is put at a value dependent on the amounts needed by the user. In this respect it is best for the automatic control of temperature to have a controlling effect on pressure automatic control, this is to say pressure control is dependent on the automatic control of the temperature. The amounts of flue gas needed by the output flue gas user are taken at a point coming after the position of mixing together of the cooled flue gases coming from the different heat absorbers; for this reason they are not run into the last heat absorber (to the flue gas stack) and are not able to give any more heat at this position. However, on turning off this user, full flue gas ducting takes place as in the case of a normal multi-pass heat producer, so that all energy on hand is able to be used for producing heat (that is to say producing steam, producing hot water or the like).

A plant for undertaking the process of the invention is based on an apparatus for ducting, routing or flow control of flue gas in a boiler with a firing space within the heat transport material (as for example water or steam) and flue gas passes, within the heat transport material as well, by way of some of which the flue gases may be run from the firing space, run back, in the opposite direction to gas motion in the firing space, to the rest of the flue gas passes and may then be run in the last-named, again in the opposite direction, to a flue gas stack. In the invention this plant is characterised in that the flue gas passes, coming from the firing space, are designed as bundles of parts with heat absorbers, the overall heat absorber size being different in each case, and between them and the flue gas passes running into the stack there is a flue gas header chamber with a further flue gas outlet for an output user and there is an adjustment unit for complete or part joining up and shutting off the outlet cross-sections of the flue gas passes coming from the firing space. A good effect is produced if, furthermore, there is a control unit, by way of which, while keeping the overall resistance at the flue gas side at an unchanging level, the flue gas outlet rate may be controlled through the further flue gas outlet. The flue gas header space may, in this respect, best be made as a flue gas direction change-round chamber, completely within the heat transport material (cooling material) at one end of the boiler. The plant of the invention is not only generally light and simple in design itself, but furthermore does not make any complex supporting systems necessary for running it. A particularly simple structure may be produced if the control unit for the flue gas outlet rate from the header space to the further flue gas outlet has a choke flap placed in the outlet, and a further choke flap placed before the position at which the flue gases are ducted into the flue gas stack, and the two choke flaps are then so joined together that when adjustment takes place they are moved in opposite directions. So it is possible to make certain, in a simple way, that the overall resistance at the off gas side, which is important for orderly operation of the burner generally, is kept within the desired range and it is possible, for this reason, to make quite certain that on joining up with a flue gas user of great size there is no undesired and sudden drop in pressure in the off gas part of the system.

In the case of a plant of the invention a good effect is produced if two flue gas passes are present running from the firing space to the header, and there is a flue gas pass joining the header with the flue gas stack. More specially, each flue gas pass is made up of a number of parallel single pipes with the same cross-section and placed near together, this making possible a simple structure using low-price pipes as are widely marketed. Dependent on the purpose of use in question, it may, however, furthermore be of good effect to make use, not of pipes, but of heat absorbers with a different geometry or, in place of a number of single heat absorbers, placed side-by-side, to have a single heat absorber of great size.

Furthermore, in another form of the invention of good effect, the adjustment unit for joining up or shutting down, completely or in part, of the flue gas passes coming from the firing space has a flap, placed in the flue gas header and by way of which the inlet openings of each flue gas pass into the header may be completely or partly shut down. In this respect the flap may be so placed that, on using it, the outlet of flue gases from the separate heat absorbers may be completely shut down or steplessly opened, dependent on the position of the flap, and a design of the flap system may be made such that with the opening of one flue gas pass there is, at the same time, a shutting down of the other pass in step and, for this reason, stepless adjustment to any desired mixing relation is made readily possible.

In a further development of the invention of good effect, the adjustment unit is able to be automatically controlled for part of complete joining up or shutting down of the flue gas passes coming from the firing space dependent on a flue gas temperature, able to be fixed beforehand, in the header.

In a still further development of the invention a pressure automatic control system is present, by way of which a pressure, able to be fixed as desired beforehand, may be kept up in the flue gas header by necessary operation of the control unit, so that in fact for example the choke flaps in the further flue gas outlet running to the output flue gas user and shortly before the point of inlet of the flue gases from the last heat absorber into the flue gas stack may undergo adjustment as desired.

For certain uses it may furthermore be of good effect if, in a plant designed with the teaching of the present invention, there is a unit for blowing in a cooling gas into the flue gas header. More specially, such a unit may have a pipe between the flue gas stack and the flue gas header for blowing off-gases into the header.

Another form of apparatus of good effect for undertaking the process of the invention making use of a once-through boiler is noted. In this respect, however, even after the flame zone a part of the flue gases at this point is run without any further cooling (or only a small degree of cooling by nearby structures) at once into the header, caused to take on the desired mixing temperature in the header by mixing in very much cooler off-gases from the off-gas stack and then completely run off to the output user. The rest of the flue gases is moved past the cooling coils (full of heat transport material) in the opposite direction and then run into the off-gas stack after cooling down.

In a further development of good effect, an apparatus for control or routing of flue gas using the process of the invention in the case of a boiler designed as a forced circulation or once-through boiler, with a radiation firing space, with pipe systems placed radially round the flame zone and designed for use with a through current of heat transport material, and designed as radiation heating faces, and furthermore with further pipe systems designed for heat transport material, and which are out of line in relation to each other and to the radiation heating faces, are placed in the flue gases produced in operation and designed as convection heating faces, and with a run-off system for flue gases, joined with a stack, after the gases have been run through the convection heating faces, is characterised in that the convection heating faces are placed after the radiation firing space and a centrally placed flue gas duct for direct take-off of flue gases from the radiation firing space with a unit for controlling the flue gas current rate, a suction unit, placed after the duct, for taking off the flue gases by suction, and furthermore an input duct, are present, by which of which flue gases moving at a position near the convection heating faces, may be run into the flue gas duct. In normal operation such an apparatus with this design may be run with a normal efficiency, if the unit for controlling the flue gas current has the effect of shutting off the flue gas duct for stopping flue gases from moving through it, all heating faces being used and furthermore the apparatus may be designed generally on the lines of DIN 4754. On the other hand, because of the take-off unit, designed to be in line with the invention, in connection with the unit for controlling the flue gas current in the different load ranges of the heater, an equal amount of flue gas may be taken from the system with nearly any desired temperature with a temperature range of about 500° C. to about 900° C.

A specially simple system with a high level of effect and which may readily be controlled, forming a development of this apparatus of the invention, may be produced if the unit for controlling the flue gas current is designed as a choke valve in the flue gas duct. However, a good effect is furthermore produced if as an inlet for the input of flue gases moving near the convection heating faces, to the flue gas duct, openings are made in the casing pipe of the flue gas duct and these openings—as seen in the direction of motion of the flue gases—are placed after the unit for controlling the flue gas current. With such a design an inlet is made which has a specially high effect and is very readily made and which, furthermore, may be worked without any further moving mechanical parts. In this respect the openings are more specially placed with an even distribution over the casing pipe of the flue gas duct and made with the same size. For certain uses it may, however, be useful as well if the openings, in a distribution over the face of the casing pipe, are present in a certain pattern in line with the purpose on hand and—maybe furthermore—have different sizes and forms. Generally, however, with the even placing of openings of the same size and the same form, it is possible to make certain of a troublefree and specially even input of the flue gases from all sides into the flue gas duct.

In this respect a useful effect may be produced if the openings have a distribution over the surface part of the casing pipe, which for its full length has convection heating faces round it on the outside. This is to make certain that in fact it is only such flue gases, which have run along the convection heating faces and, for this reason, have been cooled down to some degree, are able to go through the openings into the flue gas duct.

In a specially useful further development of the invention, the convection heating faces, placed after the radiation firing space, have pipes, which are radially out of line with each other and which together or separately to be joined up with, or shut off from the circuit of the heat transport material. Because of this the cooling down effect of the heating faces for the heat transport material, which takes effect on the flue gases moving along at this point, may be simply automatically controlled or changed and, for this reason, the temperature of the flue gases running into the flue gas duct at a position after the choke flap, and which are to have the effect of cooling down the flue gases, coming in directly from the radiation firing space without cooling into the flue gas duct for producing the desired temperature, may be acted upon as well in the desired way.

In this respect a useful effect may be produced if the take off suction unit has a fan, by way of which vacuum may be produced in the flue gas duct for taking off flue gases. In the first place this fan is responsible for seeing that a certain, generally unchanging amount, dependent on its throughput, of flue gases is taken off all the time through the flue gas duct. In this respect, by the necessary adjustment of the choke flap, controlling the cross-section of the flue gas duct for the inlet of the flue gases coming in directly from the radiation firing space, only a dependent amount of uncooled hot flue gases is let in; on the other hand, because of the vacuum produced in this respect after the choke flap in the flue gas duct in relation to points outside the flue gas duct, it is possible to make certain that flue gases coming from these points (that is to say from points near the convection heating faces), and which have been cooled down at this position, may to a certain degree be run in through the openings in the flue gas duct at a point after the choke flap into the duct for cooling down the hot flue gases in the desired way, which have come straight from the radiation firing space. In this respect the more the inlet of uncooled, hot flue gases from the radiation firing space is stopped by the choke flap in the flue gas duct, the more will be the vacuum produced at this respect and the greater will be the amount of uncooled flue gases, which are moved by vacuum at a point after the choke flap for cooling down the hot, uncooled flue gases. Then the general flue gas mixture, put at the desired temperature, goes through the fan to the output user, that is to say the user at the output of the system, while the flue gases not run into the flue gas duct after moving through the convection heating faces and in a cooled down condition, are lastly run into the off-gas stack.

A useful effect is produced if in the output duct for the flue gases to the stack and in the flue gas duct between the suction output unit (for example a fan) and the controller (for example a choke flap) for the flue gas current a further choke flap is placed in each case, and the two choke flaps may undergo adjustment dependent on each other. This makes certain that, without being dependent on the input opening of the choke flap in the flue gas duct, the overall resistance of the flue gas side is great enough for keeping up regular, stable burning.

Furthermore a specially useful effect may be made certain of if in addition, an automatic controller is used for working these two choke flaps and working the controller for the gas current in the flue gas duct so as to be dependent on a certain flue gas output temperature at a given flue gas output rate. This may be effected in a specially simple way for example, by using a thermo-element, placed at the right position, by way of which selection of the desired flue gas end temperature is fixed. Using the automatic controller of the invention, the controller for the inlet of uncooled, hot flue gases from the radiation firing space ("automatic controlling flap") is so worked that this desired, fixed temperature may be kept to. This is made possible because in the bypass hot flue gases may be taken from the radiation space; if there is an excessive amount of hot flue gases coming from the radiation firing space, the automatic controller flap is then shut down, using the controller, to such a degree that the fan, placed after, it is responsible for the taking off of cooled flue gases by way of the convection heating faces and the pipe placed after the automatic controlling flap, and which has holes in its walls.

LIST OF FIGURES

A detailed account of the invention will now be given using the working examples to be seen in the figures of the specification.

DETAILED ACCOUNT OF WORKING EXAMPLES OF THE INVENTION

Figure 1:
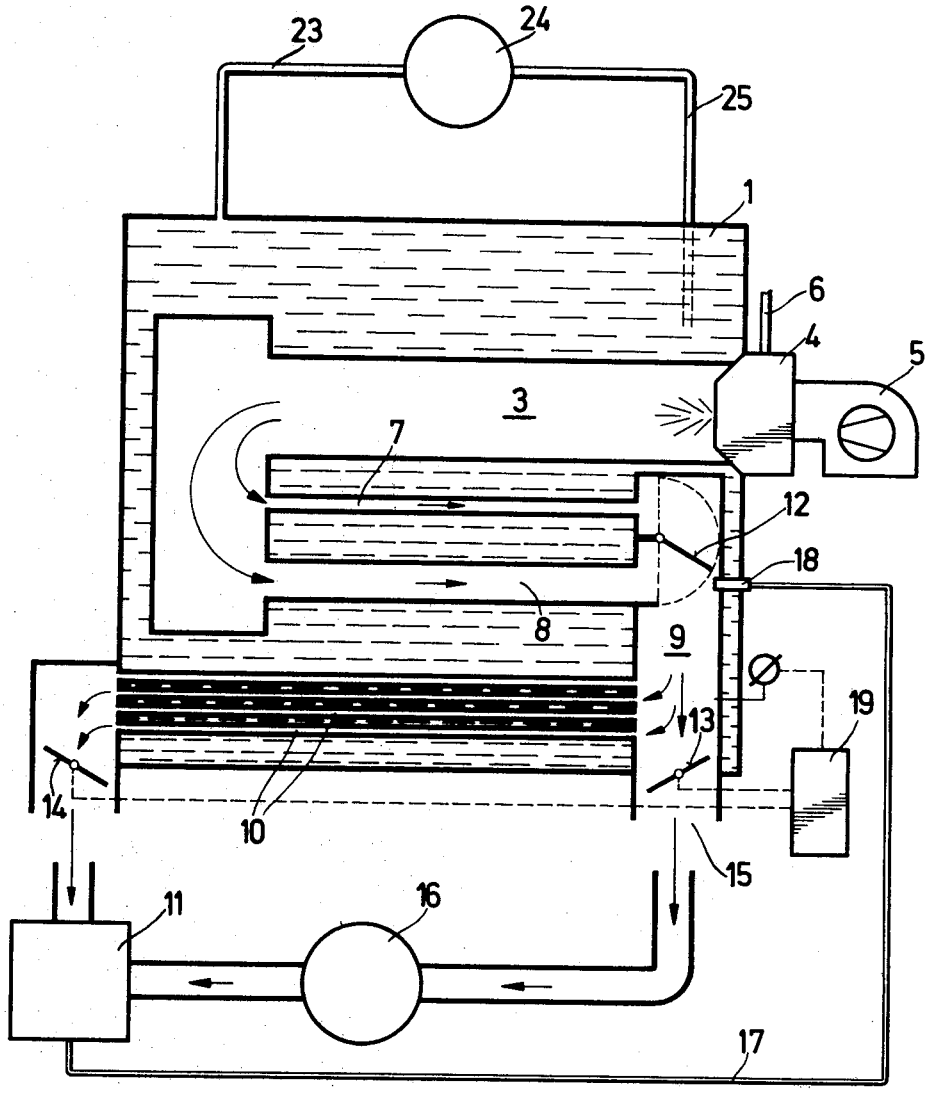
FIG. 1 is a view making clear the general teaching of the invention taking the form of an apparatus for use with the process of the invention.

FIG. 1 is a diagrammatic view of an apparatus with a boiler 1, full of a heat transport material 2 such as water, steam or any other material able to be used for this purpose. Within the boiler 1 there is a firing space 3 or furnace, on whose one side, that is to say the right hand side of FIG. 1, a burner 4, is to be seen diagrammatically presented, which has a blower 5 for the air necessary for burning or combustion and a pipe 6 for the necessary fuel. The hot flue gases, produced within the firing space 3, are moved along the firing space, are changed in direction at its other end (as made clear by the arrows) and are run into two flue gas passes 7 and 8 running in opposite directions to each other. The view of the flue gas passes 7 and 8 in FIG. 1 is only diagrammatic and is not to have the effect of limiting the invention with respect to the sort of flue gas passes able to be used. The flue gas passes themselves are in this respect more specially in the form of a number of parallel pipes of smaller or greater size, as will be generally made clear by FIG. 2. The flue gas passes 7 and 8 are in this respect to be of such a design that the overall cooling or heat absorbing face of each flue gas pass is different from that of each other flue gas pass coming from the firing space 3. The outcome of this is that the flue gas moved into the heat absorber, that is to say the flue gas pass 7, is cooled to a different degree than the flue gas going into another flue gas pass (as for example the flue gas pass 8). In this respect, as will be clear from FIG. 1, the flue gas passes, are completely within the heat transport material 2 for their full lengths. At the end of each flue gas pass, the cooled down flue gases are then run into a flue gas header 9, which, as well (though this is not made clear in FIG. 1), may be designed as a change of direction space, with heat transport material 2 round it on all sides, for the flue gases. By way of a control flap 12, placed in the flue gas header 9, the separate currents in different amounts coming from the different flue gas passes 7 and 8, of cooled down flue gases may be so controlled that within the flue gas header 9 the desired mixing temperature may be produced with the desired adjustment. A part of the mixed-together flue gases comes from the flue gas header 9 (with the new temperature produced by mixing) a further flue gas output 15, which may be shut down or opened up by way of a choke flap 13. This part of the gases and is run into a user 16, while the remainder of the flue gas from the flue gas header 9 is run into a last flue gas pass 10 (last heat absorber) and this is then run past a choke flap 14 into an off-gas stack 11. In this respect the choke flaps 13 and 14 are so joined with each other that in the flue gas header 9 the desired flue gas pressure is kept up all the time in order to make certain that the pressure conditions in the flue gas part of the plant are kept at the level necessary for non-stop operation.

From the boiler 1 (to be seen at the top of FIG. 1) the heat transport material 2, heated in the plant, is run through a transport line 23 to a user 24, from which is is run by way of the transport line 25 back into the boiler.

In the flue gas header 9 there is furthermore a unit 18, by way of which cooling gas, if further cooling gas is necessary, may be forced into the mixing zone of the header. This cooling gas—in the case of the working example of FIG. 1 —is taken from the off-gas stack 11 itself by way of a line 17.

For controlling the choke flaps 13 and 14 and, for this purpose, for automatic control of the pressure level on the off-gas side there is furthermore a pressure automatic controller 19, which, if the system goes out of the desired condition, is at once responsible for effecting the necessary adjustment of the choke flaps 13 and 14.

The flue gases coming from the flue gas header 9 by way of the further flue gas output 15 to the flue gas user 16 are then, after being used, run into the off-gas stack 11 as well.

Figure 2:
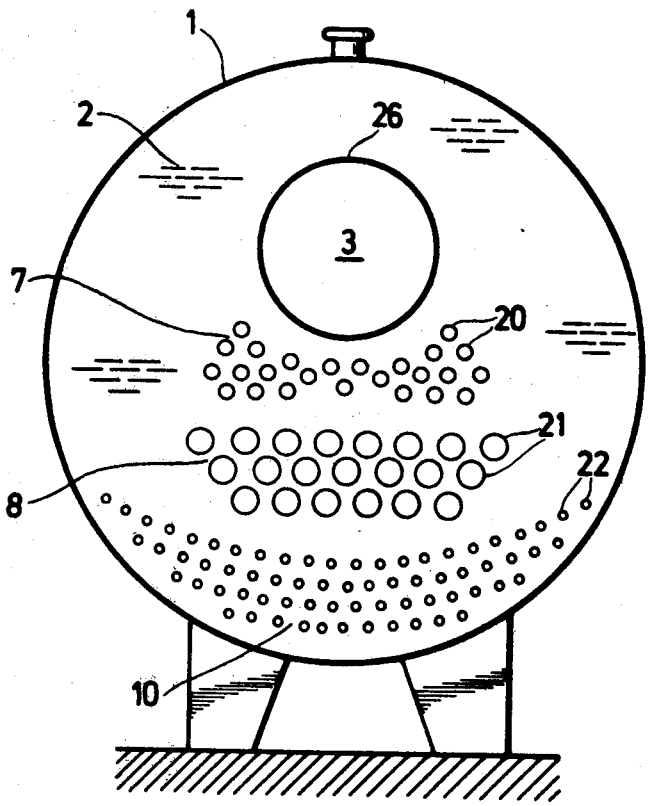
FIG. 2 is a cross-section through the (diagrammatic) view of heat boiler forming part of an apparatus in line with the invention.

FIG. 2 is a diagrammatic section of a boiler of the sort used in the plant of FIG. 1, from which the position and design of the separate flue gas passes will be readily seen.

Within the boiler 1 there is, again, the firing space 3, which is placed within a flame tube or pipe 26. Under this flame pipe a first flue gas pass 7 is to be seen, which is made up of a number of separate pipes 20 placed nearer to each other and having a generally small cross-section. Under the flue gas pass 7 the second flue gas pass 8 is to be seen, which again, is made up of a number of separate pipes or tubes 21, which are placed near together, although, however, they have a markedly greater diameter than the pipes 20 of the flue gas pass 7.

The flue gas pass 10, as the pass running from the header 9 (FIG. 1) to the off-gas stack 11 (FIG. 1), is made up (in the plant of FIG. 1) of a number of pipes 22, whose diameter is small in relation and which again are placed near together. In place of the flue gas passes to be seen, it would, however, furthermore be possible to have still more flue gas passes within the part of the plant in question, for example between the flue gas passes 7 and 8 and having diameter sizes between those of the pipes or tubes 20 and 21. Futhermore the position of the pipes might be different, for example with the flame pipe 26 not placed at the top, but to the side in the boiler 1 and the different flue gas passes would, as well, be placed to the side of it.

Because the figures are only diagrammatic and are not given with the purpose of limiting the invention, the figures do not have any details of parts of the system which are generally used in the art and come within the knowledge and experience of every expert in the field, as for example control or automatic control systems for the input of fuel at 6 or the like; it is clear that such units will be present as being necessary for the orderly functioning of the plant and may be used in the form normal for such purposes.

Figure 3:
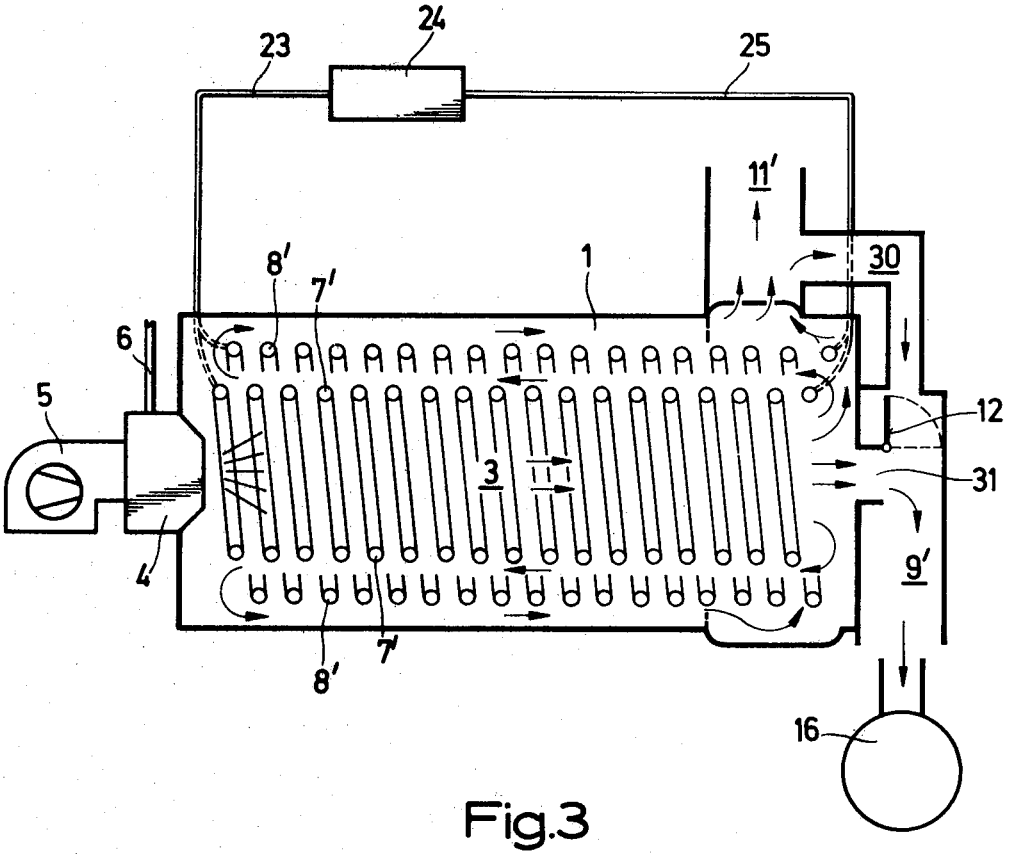
FIG. 3 is an other diagrammatic view of an apparatus of the invention taking the form of a once-through or forced circulation boiler.

In FIG. 3 a further working example of the plant of the invention is to be seen, which in this case takes the form of a once-through or forced circulation boiler. In this form of the invention the flame zone is generally in the middle and, generally equally spaced from it, there are pipe-systems 7′, more specially helical ones and, furthermore at a greater space from the flame, pipe-systems 8′ through which the heat transport material is force-pumped smoothly all the time. The radiation energy produced by burning and furthermore the convection energy is, in this case, taken up by the heat transport material moving through the pipe-systems 7′ and 8′ and the flue gases, as marked by the arrow lines, after having run through the flame zone are firstly changed in direction axially and then run along the pipe-systems 7′ and then, after being changed in direction axially again, that is to say so as to be moving in the opposite direction again, are run along the pipe-systems 8′ and then lastly go into an off-gas stack 11′.

However, a part of the flue gases produced is not run over the pipe-systems 7′ and 8′, where there is a continuous cooling of the flue gases till they are run into the stack 11′ and in fact even at the end of the firing space it is run by way of a duct 31 into a flue gas header 9′. A connection line 30 from the off-gas stack 11′ to the flue gas header 9′ makes it possible for the very much cooled off gases to be mixed with the hotter flue gases in the flue gas header 9′, so that for input to a flue gas user, placed at the output, flue gases are on hand with any desired temperature. In this respect (although not to be seen in the figures) not only the flue gas current through the duct 31, but furthermore the volume current of the off-gases able to be run from the off-gas stack 11′ by way of line 30 to the flue gas header 9′, are able to be separately controlled for readily producing the desired adjustment, in every case, of the temperature of the output flue gases going to the flue gas user. Simple forms of the mixing system within the flue gas header 9′ may be used like the units to be seen in FIG. 1.

Figure 4:
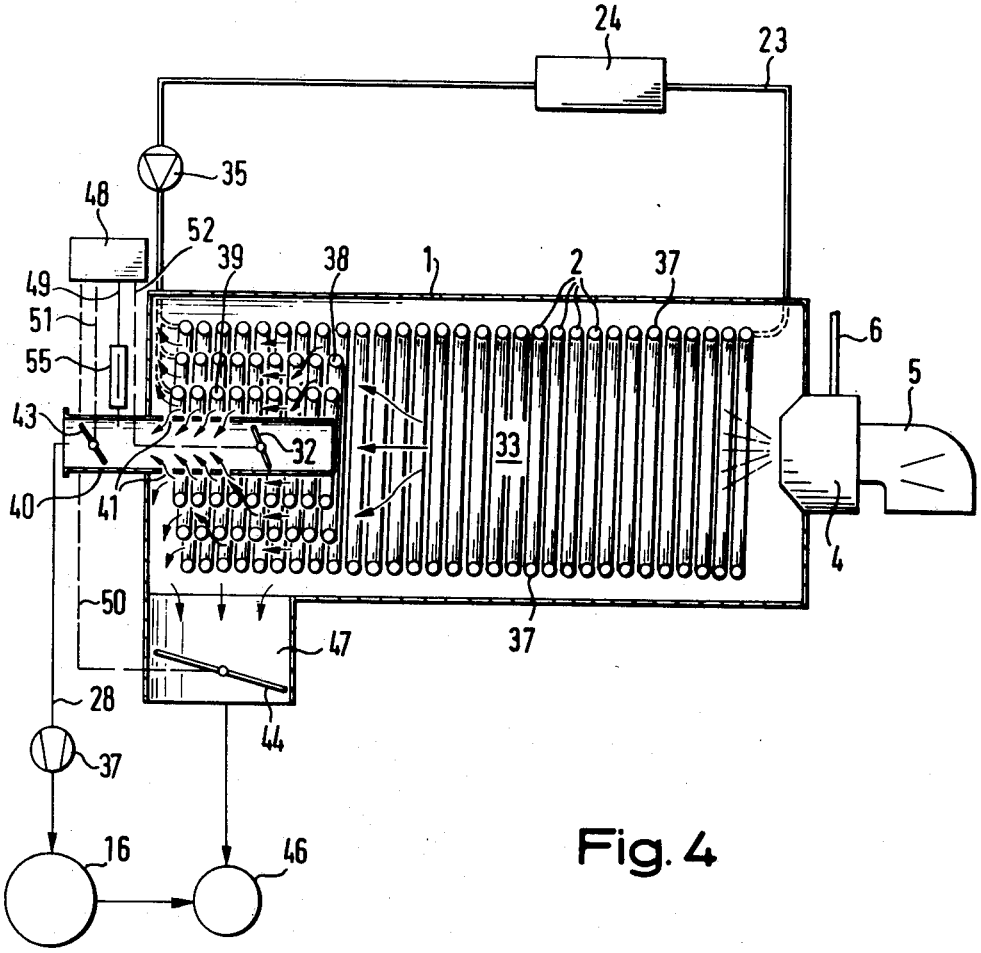
FIG. 4 is a further diagrammatic view of an apparatus of the invention taking the form of a forced circulation once-through boiler.

In the case of the plant to be seen in FIG. 4, a boiler 1, taking the form of a once-through or forced circulation boiler, has a burner 4 having a fuel input line 6 and a blower 5 for the air necessary for burning. Within the boiler 1 pipes 37 are placed at a great radial distance from the burner 4 helically round the middle axis of the boiler 1. These pipes 37 (as is made clear only by way of example at some positions in the figure) have heat transport material 2 forced through them, in respect of which they are used as heat absorbing faces. The placing and the great radial distance of the pipes 37 from the burner 4 are such that the pipes 37 in the front part (to the right in FIG. 4) of the boiler 1 take effect as radiation heating faces; the heating up of these pipes 37 is, for this reason, effected here not by convection heat transfer from the moving flue gases, but generally by the radiation of heat, coming from the flame zone ("radiation heating faces"). At the necessary design axial distance from the burner 4 there are then other pipes 38 and 39 which are out of line radially with respect to the pipes 37 and with respect to each other. These pipes 38 and 39, as well, have heat transport material 2 forced through them. In this back part (on the left in FIG. 4) of the boiler 1, the pipes 37, 38 and 39 present in the design are generally used as convection heating faces for the heat transport material 2 forced through them, this being because at this position the hot flue gases, coming from the radiation firing space placed before them in the system, are run between the separate pipes and are slowly cooled down while, at the same time, the pipes are heated up. After running past these pipes, the cooled down flue gases, not used for any other purpose, are run by way of an outlet 47, in which a choke flap 44 is placed, into a stack 46. In the system figured for this reason, the pipe designed as convection heating faces (in FIG. 4 the left hand part of the pipes 37 and the pipes 38 and 39) are placed after the radiation firing space 33, which, for its part is generally made up of the flame zone and the part, placed round it at a great radial distance, of the pipes 37 (used in this case as radiation heating faces). This radiation firing space has furthermore placed after it a central pipe-like flue gas duct 40, round which the convection heating faces are placed. The convection heating faces are, for their part, able to be joined up with and shut off from the circuit of the heat transport material separately. Within the flue gas duct 40 there is a choke flap 32 at a position, which—as seen in the direction of motion of the flue gases—is after that position, where the first loops of the convection heating faces are present for cooling down the flue gases coming from the radiation burner space. Furthermore, after the choke flap 32 there are openings 41 in the pipe or tube wall of the flue gas duct 40, through which cooled down flue gases, running between the pipes used as convection heating faces, may be run in from the outside into the flue gas duct 40. Starting from the flue gas duct 40 by way of a line 28, the flue gases are run into a flue gas user 16, and in this respect in the line 28, after the flue gas duct, there is an intermediate suction take-off unit taking the form of a fan 37. At the end of the flue gas duct 40 there is a further choke flap 43, which may be so controlled in connection with the choke flap 44 present in the outlet 47 that, in all cases, the necessary resistance on the flue gas side for even burning or combustion in the firing space 33 is made certain of, a point of the design which will be gone into later in more detail.

Between the choke flaps 32 and 43 there is a heat sensing unit 55, taking the form of a thermo-element, by way of which the temperature of the flue gas moving in the flue gas duct 40, may be measured shortly before the choke flap 43. Furthermore there is an automatic controller 48, which is used for adjustment to get the desired flue gas temperature of the flue gases in the duct 28 by controlling the flaps 32, 43 and 44 in the necessary way using signal lines 50, 51 and 52. In this respect, by way of the thermo-element 55 and a signal line 49, a signal, representative of the temperature (at one point in time) of the flue gases before the choke flap 43, is inputted as a deviation signal for the automatic control system.

The heat transport material 2 from the heat absorbing faces of the boiler 1 goes by way of a line 23 to an output heat user 24 and from it is then forced back into the boiler 1. For this purpose use is made of a pump unit 35 of the necessary design in the line 23 for effecting material circulation.

ACCOUNT OF OPERATION OF THE PLANT GIVEN IN FIGURE

Fuel coming by way of the fuel line 6 is burned by way of the burner 4 with the air coming by way of the blower 5. In the burning space 33, where the desired burning takes place, the flame zone is within the pipes 37, spaced at some distance from it, and acting as convection heating faces. The heat transport material current in these pipes is heated by the radiation (or radiative) heat going through the pipe wall. The flue gases, after coming out of the flame zone, go partly into the inner part of the flue gas duct 40 and are partly run outside the flue gas duct 40 between the separate pipes 37, 38 and 39, and at this position, generally by way of convection heat transfer, the heat transport material 2 in the pipe loops is heated up and the flue gases are cooled down. Dependent on the flue gas temperature desired for the output flue gas user 16, the choke flap 32 is moved into a certain position as fixed by the automatic controller 48, so that still under the effect of the running fan 37, the hot flue gases are moved by suction round the choke flap into the further part of the flue gas duct 40. Because of the suction of vacuum, however, produced behind the choke flap 32 in comparison with the gas outside the flue gas duct 40, flue gases, cooled down earlier, are run from the convection heating faces by way of the openings 41 into the inside of the flue gas duct 40 by suction to the (uncooled) flue gases in the form of a moving current present here in duct 40 in the first place; the mixing temperature of the flue gases is then measured further on by the thermo-element 55 which sends a representative signal by way of the line 49 to the automatic controller 48. Dependent on the fixed, desired value for the temperature, the choke flap 32 is then opened further (if a higher temperature is desired) so that a greater amount of hot flue gases may be run in from the firing space 33 itself and, because of the lower degree of vacuum after the choke flap 32, furthermore, dependent on this, less cooled down flue gases are taken in by suction through the openings 41. If, on the other hand, the temperature measured by the thermo-element 55 for the flue gas current is still higher than the desired value which has been fixed by adjustment, the automatic controller 48 on getting a signal through line 52 will be responsible for a further shut down of the choke flap 32; because of this, an even smaller amount of hot flue gases will be able to go past the choke flap 32 and at the position after this flap a greater degree of vacuum or suction will be produced by the fan 37 and, for this reason, there will be a higher input rate of cooled flue gases through the openings 41. In every case the choke flap 32 is lastly caused to go into a position (by the automatic controller 48), in which the mixing of the uncooled, hot flue gases coming from the firing space itself and the flue gases, which have been cooled down and are run in through the openings 41, is responsible for producing a flue gas current at the desired temperature. This automatic control system is furthermore used in connection with the necessary adjustment (controlled as well by way of automatic controller 48) of the choke flaps 43 and 44 for keeping up the desired flue gas side resistance. Because, in view of this, the pressure conditions for which the fan 37 is responsible, at a point after the choke flap 32, and, for this reason, the conditions of motion of the flue gas current in the flue gas duct 40 are changed generally, by way of the automatic controller 48, there is in fact the desired or necessary adjustment of the choke flaps 32, 43 and 44, so that by way of the design 28 the desired flue gas current at the desired temperature fixed beforehand to the flue gas user 16 may take place in every load range of the heater.

A certain number of separate further units are needed for the full-scale form of such a boiler (such as fuel automatic regulation systems, load automatic regulation systems etc.) which, however, do not have to be detailed for making the present invention clear to those trained in the art. Such details of units of the plant have not been given only for the purpose of making the present account of the invention more straightforward and in fact in the full-scale form of the invention such normal units will naturally be made use of.

It will be seen from the present account of the invention that it is a question of a process for flow controlling (routing or flowing) of flue gases produced in the firing space of a boiler.

The limits of the teachings of the invention are made clear by the claims of this specification, in which all measures claimed may be put together with other measures. In the present specification the wording "flue gas header" is used with the sense of "flue gas mixing chamber" into which the flue gases are run and mixed for producing the desired temperature and from the chamber run in part to the user and in part to the chimney or flue 11.

I claim:

1. A process for ducting flue gases produced in the firing space of a boiler, said boiler being of the type in which the flue gases within the boilder give up heat by being passed through heat absorbers, themselves cooled by heat transport fluid, and run ultimately to an off-gas stack, said process comprising the steps of:

dividing at least a portion of the flue gases coming from the firing space into at least two part-currents, cooling the separate part-currents to different degrees by having them give up heat to the transport fluid, mixing at least a portion of the part-currents together again to form a mixed gas current whose temperature, following mixing, is controlled by selecting the proportions of the part-currents in said mixed gas current;

running at least part of the mixed gas current to an external flue gas user.

the undivided portion of the flue gases and the portion of the mixed gas current not going to the user being run as far as through the last heat absorber to the off-gas stack.

2. A process as claimed in claim 1, further comprising: after they have passed through the heat absorbers, running the separate part-currents together again completely for forming the current of gas whose mixing temperature may undergo selection, and controlling the flue gas flow of the part-current automatically along the heat absorbers for producing the mixing temperature whose selection is made.

3. A process as claimed in claim 2, wherein the control of the flue gas flow along the heat absorbers is undertaken by opening or shutting, completely or in part, the cross-section of the heat absorbers which are in the form of pipes.

4. A process as claimed in claim 2 or claim 3 wherein, wherein the flue gas flow through at least the last heat absorber is choked back for producing a different resistance for the flue gas.

5. A process as claimed in anyone of claims 2 or 3 further comprising adjusting the rate of input of the flue gas to the user after mixing.

6. A process as claimed in anyone of claim 1, wherein the flue gas is ducted along the heat absorbers, joined with the output of the firing space, in the opposite direction to the direction of the flue gas in the firing space itself and along the last heat absorber.

7. A process as claimed in claim 1 using a once-through or forced circulation boiler, comprising the steps of dividing the flue gases into two part-currents, running one by way of the heat absorbers present to the flue gas stack and from this position mixing it, at least in part, with the other part-current again (which till this point in time has been kept generally uncooled) for producing the gas current whose mixing temperature undergoes selection as desired.

8. Apparatus for ducting or routing flue gases produced in the firing space of a boiler, said boiler being of the type in which the flue gases within the boiler give up heat by being passed through heat absorbers cooled by a heat transport fluid, said flue gases being ultimately provided to an off-gas stack, said apparatus comprising:

means for dividing at least a portion of the flue gases from said firing space into at least two part-currents;

means including at least one heat absorber for cooling the separate part-currents to different degrees;

means for mixing at least a portion of the part-currents together again to form a mixed gas current, said mixing means including means for controlling the temperature of said mixed gas current by selecting the proportions of the separate part-currents included therein;

means for providing at least a portion of said mixed gas current to an external glue gas user; and means for running the undivided portion of the flue gases and the portion of the mixed gas current not going to the user as far as through the last of said heat absorbers to said off-gas stack.

9. An apparatus in accordance with claim 8 with a firing space within the heat transport fluid and flue gas passes, within the heat transport fluid as well, by way of some of which the flue gases may be run from the firing space, run back, in the opposite direction to gas motion in the firing space, to the rest of the flue gas passes and may then be run in the last-named, again in the opposite direction, to a flue gas stack, further comprising: the flue gas passes (7, 8), stretching from the firing space (3), being constructed as bundles of heat absorbing parts, the overall heat absorbers face size being different in each case, a flue gas header chamber between the flue gas passes (7,8) from the firing space and the flue gas passes (10) running into the off-gas stack (11), said chamber having a further flue gas outlet (15) for an external heat user (16); and adjustment unit means (12) for complete and partial joining up and shutting off of the outlet cross-section of the flue gas passes (7, 8) coming from the firing space (3).

10. An apparatus as claimed in claim 9, further comprising controller means (13, 14) for controlling the flue gas outlet rate via said further flue gas outlet while keeping the overall resistance on the flue gas side at an unchanging level.

11. An apparatus as claimed in claim 9 or claim 10, characterised in that means (18) for blowing in a cooling gas is provided at the flue gas header (9).

12. An apparatus as claimed in claim 11, characterized in that the means for blowing in cooling gas has a line, placed between the off-gas stack (11) and the flue gas header (9), for blowing off gases into the header (9).

13. An apparatus as claimed in claim 10, further comprising the controller for the flue gas outlet rate from the header space (9) to the further flue gas outlet (15) has a first choke flap (13) placed in the outlet, and a further choke flap (14) placed before the position at which the flue gases are ducted into the flue gas stack (11), and means for coupling the two choke flaps (13, 14) so that when adjustment takes place they are moved to produce opposite effects.

14. An apparatus as claimed in any one of claims 9, 10 or 13, characterised by the two flue gas passes (7, 8) running from the firing space (3) to the header (9) and a flue gas pass (10) joining the header (9) with the off-gas stack (11).

15. An apparatus as claimed in any one of claims 9, 10 or 13, characterised in that each flue gas pass (7, 8, 10) is made up of a number of parallel single pipes (20, 21, 22) with the same cross-section.

16. An apparatus as claimed in any one of claims 9, 10 or 13, characterised in that the adjustment unit means for joining up and shutting down, completely and partially, of the flue gas passes (7, 8) coming from the firing space (3), has flap means (12), placed in the flue gas header (9) for completely and partially shutting down the inlet openings of each flue gas pass (7, 8) into the header (9).

17. An apparatus as claimed in any one of claims 9, 10 or 13, characterised in that the adjustment unit includes means for automatically controlling partial and complete joining up and shutting down of the flue gas passes (7, 8) coming from the firing space (37), dependent on a previously selected and automatically controllable flue gas temperature in the header (9).

18. An apparatus as claimed in any one of claims 9, 10 or 13, characterised by a pressure automatic controller means (19) for maintaining a previously selected pressure in the flue gas header (9) by using control of the controller means (14, 15).

19. An apparatus as claimed in any one of claims 9, 10 or 13, characterised in that the flue gas header (9) includes means providing a change in direction in the header (9) at the end of the boiler (1), the boiler having heat exchange walls through which the heat transport fluid (2) of the boiler (1) is forced on all sides of the header.

20. An apparatus as in claim 8 for use in a once-through or forced circulation boiler wherein said cooling means includes a number of substantially helical pipe coils each forming a generally concentric coil about the burner flame at a different distance therefrom and downstream therefrom in the direction of flow of the flue gases from said burner, said pipe coils having the heat transport fluid pumped through them, said dividing means including means for changing the direction of flow of at least one of said part-currents at opposite ends of said pipe coils so that said part-currents change direction each time they flow about a different pipe coil, gases moving about the outermost coil being run into said off-gas stack, said apparatus further comprising a flue gas header (9'), and means in said dividing means operable to run part of the flue gases directly from the vicinity of said burner flame and without moving about said pipes (7', 8') into said header, said mixing means including means (30) for directing the off-gases from the off-gas stack (11') into the flue gas header (9') for mixing with and cooling down the flue gases at a controlled rate.

21. An apparatus as in claim 8 for use in a once-through or forced circulation boiler with a radiation firing space, wherein said cooling means includes outer pipe means placed radially about the flame zone for conducting a through current of heat transport fluid, and defining radiation heating faces, and further pipe means for conducting heat transport fluid which are downstream of and remote from said firing space, said further pipe means being generally concentric with said outer pipe means and having different diameters, said further pipe means defining convection heating faces, and said means for running including a take-off system for flue gases joined with said stack and disposed downstream of said convection heating faces, said mixing means including a flue gas duct (40) generally concentric with said pipe means, for direct take-off of flue gases from the radiation firing space (33), means (32) for controlling the flue gas current rate, suction means (37) placed after the duct (40) for taking off the flue gases by suction, and input ducts (41) formed in said flue gas duct, by way of which flue gases moving at a position near the convection heating faces (38, 39) are run into the flue gas duct (40).

22. An apparatus as claimed in claim 21, characterised in that the means for controlling the flue gas current is a choke flap (32) placed in the flue gas duct (40).

23. An apparatus as claimed in claim 21 or claim 22, characterised in that, as an inlet for the input of flue gases moving near the convection heating faces (38, 39) to the flue gas duct (40), openings (41) are present in the periphery of the flue gas duct (40) and these openings, are placed after said means (32) for controlling the flue gas current.

24. An apparatus as claimed in claim 23, characterised in that the openings (41) are evenly distributed over the casing pipe of the flue gas duct (40) and are of the same size.

25. An apparatus as claimed in claim 24, characterised in that the openings (41) are distributed over a portion of the periphery of the flue gas duct (40), which portion for its entire length has convection heating faces (38, 39) placed around it.

26. An apparatus as claimed in any one of claims 21 or 22, characterised in that the convection heating faces are placed after the radiation firing space (33) and said pipe means each comprise a substantially helical coil of pipe (37, 38, 39), each of said coils having a different diameter, and means for joining said coils up with and shutting them off from the flow of the heat transport fluid (2) in said outer pipe means.

27. An apparatus as claimed in any one of claims 21 or 22, characterised in that the suction means has a fan (37), by way of which vacuum may be produced in the flue gas duct (40) for taking off flue gases.

28. An apparatus as claimed in any one of claims 21 or 22 further comprising further choke flaps (43, 44) disposed, respectively, in the take-off system (47) for the flue gases to the stack (46) and in the flue gas duct between the suction output means (37) and the controller (32) for the flue gas current, said further choke flaps (43, 44) being coupled for adjustment relative to each other.

29. An apparatus as claimed in any one of claims 21 or 22, further comprising automatic control means (48) for working the further choke flaps (43, 44) and working the control means (32) for the gas flow in the flue gas duct (40), dependent on a given desired flue gas take-off temperature at a given desired flue gas take-off rate.

* * * * *